US008061100B2

(12) United States Patent
Peleg

(10) Patent No.: US 8,061,100 B2
(45) Date of Patent: Nov. 22, 2011

(54) SELF SUPPORTING ROOFING PLATE

(76) Inventor: Reuven Peleg, Hod Hasharon (IL)

( * ) Notice: Subject to any disclaimer, the term of this patent is extended or adjusted under 35 U.S.C. 154(b) by 0 days.

(21) Appl. No.: 12/721,935

(22) Filed: Mar. 11, 2010

(65) Prior Publication Data

US 2010/0223871 A1 Sep. 9, 2010

Related U.S. Application Data

(63) Continuation of application No. 10/792,922, filed on Mar. 5, 2004, now Pat. No. 7,707,791.

(51) Int. Cl.
*E04D 1/00* (2006.01)

(52) U.S. Cl. ..... 52/531; 52/537; 52/555

(58) Field of Classification Search ..... 52/531–538, 52/551–555

See application file for complete search history.

(56) References Cited

U.S. PATENT DOCUMENTS

| | | | |
|---|---|---|---|
| 2,870,981 | A | 1/1959 | Dellinger |
| 3,629,988 | A | 12/1971 | Zylstra |
| 3,884,328 | A | 5/1975 | Williams |
| 4,499,700 | A | 2/1985 | Gustafsson |
| 4,617,773 | A | 10/1986 | Studwell |
| D288,771 | S | 3/1987 | Kero |
| 5,056,288 | A | 10/1991 | Funaki |
| 5,479,752 | A | 1/1996 | Menegoli |
| 6,715,256 | B1 | 4/2004 | Fischer |

FOREIGN PATENT DOCUMENTS

| | | | |
|---|---|---|---|
| AU | 25313/77 | A | 11/1978 |
| AU | 78427/81 | A | 7/1982 |
| EP | 0017647 | A1 | 10/1980 |
| EP | 0115968 | A1 | 2/1984 |
| EP | 0126719 | A2 | 5/1984 |
| EP | 0317923 | A1 | 5/1989 |
| EP | 00964114 | A2 | 12/1999 |
| EP | 1236840 | A1 | 9/2002 |
| EP | 1342862 | A1 | 9/2003 |
| WO | 81/03196 | A1 | 11/1981 |

OTHER PUBLICATIONS

ISR for PCT/IL2005/000261.
ISR for PCT/IL2005/000261 mailed 2005.

*Primary Examiner* — Jeanette E Chapman
*Assistant Examiner* — Daniel Kenny
(74) *Attorney, Agent, or Firm* — Lowe Hauptman Ham & Berner LLP

(57) ABSTRACT

Self supporting roofing plate for pitched roofs having purlinless roofing construction is disclosed. This particular roofing plate allows for the rafters of the purlinless construction to be spaced apart as twice as allowed when using best known prior art products, thus significantly reduces costs and labor of the complete roofing construction.

10 Claims, 8 Drawing Sheets

FIG. 1 (Prior Art)
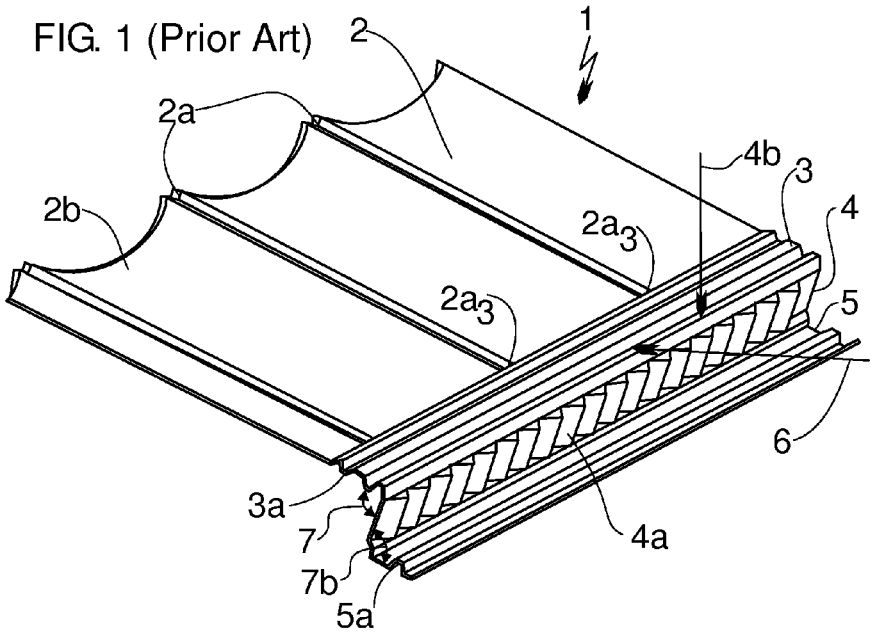
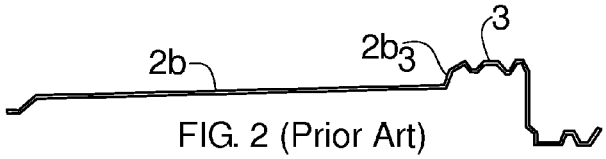
FIG. 2 (Prior Art)
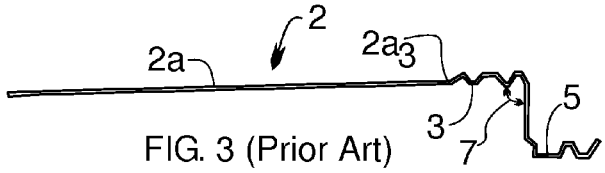
FIG. 3 (Prior Art)
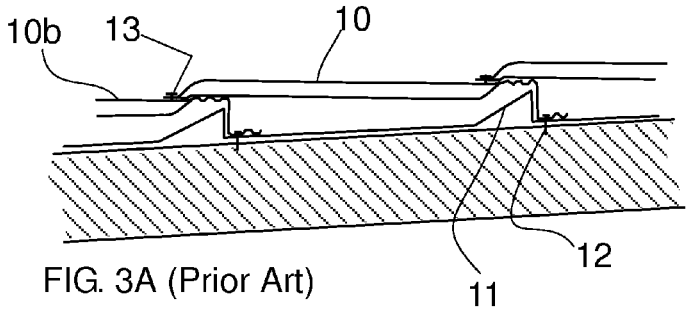
FIG. 3A (Prior Art)

SELF SUPPORTING ROOFING PLATE

RELATED APPLICATIONS

The present application is a continuation of U.S. application Ser. No. 10/792,922, filed Mar. 5, 2004, the disclosure of which is hereby incorporated by reference herein in its entirety.

FIELD OF THE INVENTION

The present invention relates to the field of self supporting roofing tiles.

BACKGROUND OF THE INVENTION

Although the commercial market of tile roofing is quite crowded, and a competitive one, it is yet very conservative in terms of costs per square meter, that is nearly the same all around the globe. It seems that during several decades of years, or even more, there have been achieved a stable balance between the requirements in which a roofing element should withstand (i.e. minimal load to be carried by, its stability to wind and so on) and between the minimal quantity of raw material that should be used in order to comply with the requirements. When referring to sheet metal tiles, for example, the costs per square meter are mainly derived from the price of steel in the international market, that is substantially fixed.

It is therefore a very high motivation for the competitor manufacturers in such market to affect a reduction, let say even of a few fractions of a percent, in their expenses per square meter roofing.

On the background of said conservative market, the object of the present invention is to provide the knowledge how roofing costs may be reduced in tens of percents.

It should be considered that although the discussion from now on in this specification will hang around steel made roof tile, the present invention does not limit itself to this specific material. The same principles that will become more apparent after reading the technical parts of this text, apply for a variety of manufacturing materials without departing from the scope of this invention.

More than twenty years ago, the invention disclosed by the WO 81/03196 publication (hereinafter will be referred to as "D1") was aimed and directed to show how the purlins that used to be an integral part of the traditional infrastructural construction of tile roofs, are replaced by purlins that are integral part of the roofing tile itself, while the roofing infrastructural construction is comprised of rafters only, i.e. without purlins.

The integral purlin according to said invention is made in the tile by a modification in its shape and with no significant increase in the amount of material that should be used. The actual implementation of said patent could be found in a product named "Scanroof", which is manufactured by the assignee of the invention disclosed by said D1 publication.

The benefit in using this D1 invention is double: firstly there is a reduction in the amount of material that should be used for the infrastructural construction since purlins are no more necessary, and secondly there is a reduction in the working time that should be spent to erect the economical construction.

U.S. D288,771 publication (hereinafter will be referred to as "D2") discloses a support strip which as could be appreciated is aimed not only for supporting but also to help in positioning and assembling of the D1 type tile, that is necessary since the tile itself does not contain means that ensures precise positioning and assembling of one roofing sheet respect to another, and as will be explained in detail in the following chapters of this specification.

As mentioned before, the motivation of a manufacturer to reduce production costs is clear, hence, it is believed whether there was a chance to utilize the technical features disclosed by said inventions by those who skill in the art in order to reduce roofing production costs furthermore, it was completely exhausted, either by the assignees of the patents that were granted to said invention in several countries, or by manufacturers in other countries, were the invention was not protected. More than three years after the expiry of the patent term, and despite of a long felt need, no body in the market of steel tile roofing shows ability to break through the bar and to reduce the roofing manufacturing costs beyond the effective limits determined by said invention.

It is therefore an object of the present invention to provide a new set of features that will allow for a reduction of up to several tens of percents in the manufacturing costs of steel tile roofing.

SUMMARY OF THE INVENTION

As mentioned above in the background chapter, the aim of the D1 was to replace the traditional purlins commonly used in conventional roofing constructions, with a Z-beam supporter that is an integral part of the tile. While the D1 invention, and the derivates "Scanroof" product were concentrating in the avoidance of external purlins as a means to reduce roofing costs, the present invention will concentrate in another factor of roofing costs, that is the rafters construction, and after decades of years standstill in that field of the art, the present invention will provide the breaking through guidelines which will allow for a further reduction of up to 50% in the complete roofing costs. While the D1 invention, and the derivates "Scanroof" product, gave neither guidelines nor motivation to deal with the infrastructural roofing construction beyond the avoidance of purlins, the present invention deal, and motivation, is in thinning out the rafters construction to minimum.

Referring again to D1, and studying the actual products manufactured accordingly in the global market, show the limit of 1.5 meter maximal gap allowed between each two rafters of the infrastructure construction of the roof. This max allowed gap is reflected from the features of the sheet metal tile, which at a preferred given thickness of material would not be able to withstand expected loads in case it will be supported by rafters that are spaced in a greater gap.

The present invention is aimed to increasing said max gap of 1.5 meter between each pair of rafters, in between 35% (e.g. when implementing the principles of the present invention in a partial manner) and 120% (e.g. when implementing in full the principles given by the present invention), namely to a meaningful gap of between 200 and up to 330 cm without decreasing the performances of the prepared roof. The resulting reduction in the total number of rafters required for the roofing construction, together with the resulting reduction in the labor required for erecting the roof shows the breaking through reduction of up to 50% in the total roofing cost. According to another perspective, the present invention will allow for loading a given tile roof (e.g. by snow) by e.g. two, three, or four times weight (depending on the extent of utilization of the principles of the present invention), comparing to any other tile roof using the same quantity (weight) of material per square meter roof and having the same gap between its rafters in a purlinless infrastructure construction.

Although the present invention is naturally aimed to allow a meaningful increase in the max allowed distance between rafters (according to the preferences of the inventor of the present invention meaningful in this regard relates to let say an improvement of at least one third, that is about 35%, more preferably of at least 70%, and most preferably of at least 100% and more) one whose requirements are modest may want to improve the capabilities of prior art roofing plates only in part, for example by 10% only by 20% only, by 30% only (or by any other percentage lesser than may be achieved when full implementation of each and all of the principles outlined by the present invention are carried out) through a deficient implementation of any of the principles outlined by the present invention. Such deficient implementation should not be considered as departing from the scope of protection as defined by any separate claim of the present invention, regardless of what actual percentage of improvement was achieved by the deficient implementation of the principles defined by the claims.

Accordingly, a method is herewith disclosed, for enlarging by 35% and beyond the max allowed distance between neighboring rafters in purlinless roofing construction for self supporting roofing plates for pitched roofs having ridge and eaves, the enlargement is comparing to the max allowed distance when using roofing plates made of similar amounts of raw material and without making use of the method, the method comprising the production of roofing plates of a length greater than the max allowed distance to be achieved by the method, and having at least one of the following reinforcements; (a) continuous upright double wall support comprising two upright walls forming a gap in between uninterrupted along the entire longitudinal dimension of the plate, a first of the two upright walls is being oriented toward the ridge and the second of the two is being oriented toward the eaves, when the roofing plate is mounted on a roof; (b) integral mini ribs located at the boundary region between a top wall of the plate and at least one upright wall of the plate, acting as struts connecting between mid portions of the upright wall and corresponding mid portions of the top wall; (c) integral mini ribs located at the boundary region between an upright wall of the plate and between a horizontal flange bent from its lower end, acting as struts connecting between mid portions of the upright wall and corresponding mid portions of the flange. The production of the roofing plates according to the method and their availability in the market, will enable roof constructors to prepare purlinless infrastructure constructions for pitched roofs, with widely spaced apart rafters distant from each other by two or three meters and even more, thus saving labor and costs.

For the aim of clarity, in the context of the present invention the tile (hereinafter referred to also as "roofing plate") structure will be divided to the following regions—

Rear side—the side of the roofing plate aimed to be oriented toward the ridge of the roof.

Front side—the side of the roofing plate aimed to be oriented toward the eaves of the roof.

Horizontal surface—the main surface of the roofing plate, aimed to be facing the sky.

Top wall—the wall who is leveled at the max height of the roofing plate and who is aimed to be covered and hidden by the horizontal surface of a roofing tile neighboring from above. The top wall may also be a marginal meeting region between two upright walls, wherein the area of the top wall tends to nearly zero, or is undefined, or is somewhat uneven or wavy, e.g. when two upright walls having a gap in between has a cross sectional shape of an inverted U or of an inverted V, or of the letter M. (when referring to the top wall of the D1 type tile, or to roofing plates having Z-beam support, wherein the top wall and portions of the horizontal surface of, the tile or the plate are leveled the same, the intention in the wording "top wall" is to the top wall of the Z-beam only, i.e. that part extending between the upright wall of the z-beam and between the wavy main surface of the tile).

The roofing plate of the present invention will be further disclosed by setting out in detail the principles according which it should be designed and manufactured.

A first principle of the present invention is to provide a tile with an inherent double wall vertical support along the entire length of the tile (hereinafter referred to also as "roofing plate"). This is in contrast to the D1 invention wherein there is a continuity of only a single vertical wall. Although the D1 illustrates in its FIG. 5 a cross sectional view of a tile which at first glance has a double wall support, a brief glance at the other figures (e.g. FIGS. 9 and 10) of said invention will discover that this seemingly double wall support is fake, in that it becomes a single wall support each time the wavy shaped surface of the tile reaches an apex. In addition, and as will be further explained in detail hereinafter in the text of the fourth principle, also along those extents of the D1 the where a second vertical wall does exist, it is not effective as a real vertical support since it has a relatively flatten angle to the horizontal. This flatten angle does not allow for connecting the tiles to one another by a horizontally oriented joining screw, as it is evident from the Scanroof actual product, and from the vertically oriented joining that is to be used for connecting one tile to another according to the D1 invention (for clarity see FIG. 3A, illustrating the assemblage of an actual product based on the D1 and D2 inventions). Two main disadvantages are involved with such vertical joint between the tiles, as will be detailed hereinafter by the text of the fourth principle. This fake double wall support (which as explained, is not a full double wall support since one of the walls is interrupted in fixed intervals according to the wavy shape of the horizontal surface) cause a meaningful reduction in the strength of that local regions of the tile were the double wall support actually becomes a single wall only (i.e. at the apex regions of the horizontal wavy surface of the tile), which in turn reduces the entire capabilities of the tile to withstanding vertical loads.

Furthermore, it should be emphasized that as can be appreciated from the figures (either of the D1 document and of the present invention), the term 'vertical' in the context of either the single or double wall support does not strictly relates to a pure vertical orientation, but to a position that is much closer to the vertical than to the horizontal, which in a double wall embodiment forms the side walls of a trapezoid shape. The vertical orientation and the orientation of a side wall of a trapezoid shape, are both referred to also as "upright" orientation, in the context of the present invention.

The incline of the trapezoid shaped walls is essential in the aspect of stacking a plurality of similar tiles for storage or for delivery (it is self explanatory that pure vertical double wall, does not allow for stacking one inside another), wherein the trapezoid-like gap allows for minimizing the space between the horizontal surfaces of stacked tiles to nearly zero. It should be appreciated that using the term trapezoid is only for describing the mutual orientation of the two side walls and in no manner intends to limit the scope of the present invention. In this regard, every double wall vertical (or upright) support located continuously all along the rear side of the tile, with a gap in between the two walls, and with the frontal one of the double wall extends in one line between a top toward which it is elevating sharply and discernibly for at least eight or ten millimeters (in the worst and very unrecommended situations), and more preferably for at least twelve millimeters (and up to several tens of millimeters) above the apexes of the horizontal surface of the tile and between a bottom that follows the wavy shape of the horizontal surface, should be appreciated as included in the scope of the present invention.

It should be appreciated that the sharp and discernible elevating of the frontal one of the double wall toward its top above the apexes of the horizontal surface, is essential not only for dramatically improving the supporting capabilities of the tile, but also to effectively block storm winds and to completely prevent rain water crawling by storm winds from an infiltration over the top of the tile and into the house. In the D1 invention the top of the tile is at a similar level as the apexes of the horizontal surface, i.e. it lacks a frontal wall that is sharply elevating from above the apexes of the horizontal surface. Therefore, the self-supporting tile according to the present invention has improved wind and water protecting capabilities comparing to the D1 invention, and comparing to the Scanroof product that has a frontal wall with a relatively flatten angle to the horizontal.

However, and as already mentioned above, the vertical support walls are not completely vertical, rather form a trapezoid shape, in order to allow stacking of the plates one above another. There is a disadvantage in this inclined orientation of the vertical support walls, which is their tendency to open the trapezoid shape wider upon a vertical pressure on the tile (hereinafter will be referred to also as "flattening tendency"). The flattening tendency of the vertical supporting walls has been recognized by the inventor of the present invention as the most significant obstacle existing in the way of improving the tile resistance against loads, an obstacle which the D1 invention does not refer to. The flattening tendency problem is more critical in the rear vertical wall, because the moment exerted on it is greater due to its greater height (and, in the WO 81/03196, also due to the fact that the front wall is fake, i.e. exists only at the valley regions of the horizontal surface, where it is protected in between the apexes). Once such pressure on the roofing plate widens the trapezoid shape, the vertical support stamina deteriorates (since it becomes more horizontal) which encouraging a possible collapse of the tile. The principles of the present invention inter glia come to reduce to minimum the tendency of the vertical supporting walls to flatten towards the horizontal under vertical loads such as those resulting from snow, from a person walking on the tile (either during its build or during maintenance work on a prepared roof), or from loads suspended from the tile inside the house. Said first principle of the present invention reduces the flattening tendency of the vertical supporting wall facing the apex, by dividing the vertical loads exerted on the tile between two full none faked vertical walls, having no dead regions as existing at the apex regions of the horizontal surface of the D1 product.

Once again, the first principle of the present invention is to provide the tile with a continuous non-interrupted double wall vertical support, that will increase the tenability of the tile (and in turn of the entire roof) against vertical loads and that will reduce the flattening tendency of the rear vertical wall.

A second principle of the present invention is to solve an inevitable problem appended to the implementation of the first principle. In this regard, it should be remembered that the present invention (as well as the WO 81/03196) relates to relatively long dimensioned tiles, i.e. which are usually having a length of at least several meters each (regardless of what is the max allowed space between the rafters). Furthermore, these types of metal tiles are used to be painted and coated by aggregated rough coating materials.

The problem to be solved is that when stacking such tiles having two non faked vertical (in the context of the present invention the term "vertical" when relating to the walls which intend to support the tile without the help of purlins, does not come to say pure vertical, because pure vertical will not allow stacking one tile inside another, rather to say close to vertical or substantially vertical, in order to allow stacking) walls, and especially when using long dimensioned ones (which is the case under discussion), the tiles become locked one inside another (in the gap area between the vertical walls) under the friction forces acting between the outer wall surfaces of one tile and the inner wall surfaces of an adjacent tile positioned from above, and due to the accumulated weight of the remaining tiles stacked above, which presses the tiles lock.

This problem disables normal stacking of tiles for economical storage and delivery, which complicates the pack process of the tiles and dramatically increase the room required for their storage and delivery, and in turn the costs involved.

One solution for this problem, which is a non-preferred embodiment of the second principle of the present invention, is to provide external spacers such as strips of foamed polystyrene, or the like, to be placed between the top walls of the trapezoid shape of each pair of adjacent tiles in the stack.

The preferred embodiment according to the second principle of the present invention is to provide the tiles with integral spacers. The integral spacers according to the present invention are made of the same sheet of material from which the tile is made; and are produced as at least two vertical protrusions, protruding downwardly from the top wall of the trapezoid shape, and located among the two side walls of the trapezoid remotely from one another along the longitudinal direction of the side walls. The protrusions are of height useful for contacting the top of another similar tile located from below before it reaches a lock position inside the top portion where the protrusions are located.

When the tile is made of sheet metal, the protrusions are produced by cutting out (from three directions only) and bending small appropriate regions of the top surface of the tile for having them protrude among the two side walls. According to the preferred embodiment the protrusions are bent in substantially right angle from the top surface and produced with random intervals between them in order to prevent the protrusions of one tile from poking at cutouts of corresponding protrusions of an underneath tile.

Implementation of the above mentioned principles allow for a significant reduction in the costs per square meter roofing. The first principle allows for increasing the maximum allowed space between rafters in tens of centimeters, thus to save certain costs involved in the constructing material and labor. The second principle allows for maintaining cost effective packing process (in terms of storage and delivery room). The implementation of both principles together may provide a reduction of between 15% and 30% in the costs involved in the roof construction (labor and material). Implementation of both first and second principles together with the implementation of the third one, as will be detailed hereinafter, will improve the resistance of the tile of the present invention against loads furthermore, thus allowing to increase the allowed space between rafters up to a distance of 330 cm, while dramatically reducing the roofing costs. According to inventor calculation, there will be a reduction of nearly 50% in the complete roofing costs when the principles of the present invention are followed.

The third principle of the present invention is to further improve the resistance of the double wall vertical support from flattening in load conditions. As mentioned in the first principle, the first improvement in reducing the flattening of the rear wall of the tile was the addition of another continuous and non interrupted vertical wall which divides loads between the two walls, thus reduces the load exerted upon the rear wall and decreases its flattening tendency. According to the third principle of the present invention, the boundary region between the top wall of the tile and at least one of the vertical supporting walls should be provided with a plurality of mini ribs for reinforcement at predetermined intervals along the walls. These mini ribs act as struts connecting between mid portions of the vertical wall and corresponding mid portions of the top wall of the tile, which resist increase in the bending angle between the vertical wall and the top portion of the tile.

According to the preferred embodiment of the roofing plate of the present invention both vertical supporting walls has mini ribs connecting them to the top wall in order to resist flattening of their upright orientation. As will be further explained in detail hereinbelow, the lower end of the rear upright wall may comprise according to various embodiments of this present invention a horizontal extension bent from its lower end to form a convenient contact and connecting region with the widely spaced apart rafters of the roof construction. Preferably, the third principle applies also to the bending area between the lower end of the upright wall and the horizontal extension, therefore, according to various preferred embodiments of the present invention having a horizontal extension at the lower end of the rear upright wall, mini ribs are formed at the bending area in order to prevent flattening of the upright wall respective to the horizontal extension wall. This mini ribs reinforcement reduces furthermore the tendency of the upright wall to flatten under load conditions, since it fixes the rear upright wall to the rafter below in its normal orientation, through the connection of the extension to the rafter and due to the reinforcement given by the mini-ribs.

When the tile is made of sheet metal, the ribs are preferably made as small deformations produced by forming a plurality of tiny depressions shaped like ribs that connect between the vertical supporting wall and the top wall at intervals of between several centimeters and up to several tens of centimeters (according to needs, and with respect to the size of the ribs) along the longitudinal dimension of the top and the vertical walls.

A fourth principle of the present invention relates to the connection between the tiles. According to the preferred embodiment of the present invention the tiles are connected to each other by means of a horizontally oriented joining member, for example a screw. The horizontally oriented screw ensures appropriate positioning of one tile respective to the adjacent one, because it tightens the front vertical wall of an upper tile to the vertical front wall of the double wall vertical support of the tile underneath as a constraint of the screwing operation, thus avoiding imprecise positioning between roofing plates. This is contrarily to the D1 invention, wherein there is no prevention for connecting the joining member between improperly positioned tiles, since the connection does not constrain precise positioning of a tile as an inescapable condition for being able to join it to another (the connection area of an upper tile of D1 through which pass the joining member, may overlap the horizontal surface of the tile underneath at any point along the surface, thus allowing the fastening of the joining member at any such point regardless whether or not the upper tile is in its appropriate assembling position). In order to solve the problem of inaccurate positioning of the D1 type tiles, there was developed the positioning strip defined by the U.S. D288,771 publication (hereinafter will be referred to also as D2). As can be clearly appreciated, since the fourth principle of the present invention provides an inherent means in the roofing plate that ensures accurate positioning, it eliminates the need in a positioning strip, thus saves the costs, logistics and labor, involved in supplying measuring and fixing in advance, the strips disclosed by the D2 which is required for the assembling of the D1 type tiles. Furthermore, the horizontally oriented joining member according to the present invention eliminates the need in a frontal tongue as required by the D1 type tile for placing a vertically oriented joining member. This extra raw material spent for the tongue portion according to the Plannja product, can be utilized according to the present invention for creating the second upright wall, or for enlarging the height of the upright supporting wall (or walls), which in turn, increases the load withstanding capabilities of the roofing plate of the present invention (while enhancing blocking of winds and rain as explained hereinbefore), allowing to furthermore increase the space between the roofing construction rafters. Referring again to the fourth principle, the frontal wall of the roofing plate of the present invention is preferably pre-fabricated with holes at the appropriate locations where the joining screw is to be inserted, thus prevents miss location of the screw by a constructor in field conditions. The holes are located in an upper region of the vertical wall, so that the joining between tiles will be made above or near the apexes of the horizontal surface in order to prevent rain water infiltration. This is contrarily to the D1 wherein the joint between tiles is made through the horizontal surface, with a greater chance of leak of rain water through the apertures of the joint.

To summarize, the present invention discloses between its various embodiments a self supporting roofing plate, a plurality of which are to be fit together for covering pitched roofs having ridge and eaves, in a manner allowing for a sparse supporting structure of the roof having widely spaced apart rafters without crossing purlins, the roofing plate is made of a sheet of material formed to comprise at least the following four principal non-interrupted walls;

(a) a first and a second upright walls forming a gap in between (and connected to each other from above, by a top wall of the roofing plate, as will be described hereinafter) and both are extending along the entire longitudinal dimension of the plate for self supporting of the plate, the first wall is being oriented toward the ridge and the second wall is being oriented toward the eaves, when the roofing plate is mounted on a roof;

(b) an upright third wall, also being oriented toward the eaves, parallel to and adjacent the second upright wall of a neighboring similar roofing plate when the roofing plates are mounted on a roof;

(c) a fourth wall extending along the entire longitudinal dimension of the plate leveled and delimited between the bottom of the upright second wall and the top of the upright third wall and being oriented facing the sky when the roofing plate is mounted on a roof;

The second upright wall has a minimum height greater than 1 cm, and preferably is of several centimeters.

According to various preferred embodiments the second upright wall forms an angle with the fourth wall not greater than 105 degrees.

Preferably the roofing plate is further comprising integral spacers located inside the gap between the first and the second principal walls. The spacers are cut and bent from a top wall of the roofing plate, that is the area where the first and the second upright walls are connected to each other, and as mentioned before this area may have a width of between 0 cm (in an embodiment where the first and the second upright walls form an inverted V shape cross section view; in this case however there is no need in spacers since V shapes dose not use to lock one inside another when stacked) and between several centimeters (in case the top wall is wide, e.g. when the first and the second upright walls are connected in an inverted U shape, or in the form of an M), all according to the design of the specific embodiment. It should be appreciated also, that the gap width may vary between the walls, according to the contour of the upright walls delimiting it. Furthermore, the first upright wall is naturally formed greater in several centimeters from the second upright wall, thus the gap is ending with the lower end of the second upright wall (and from there and below the first upright wall continue downwards separately, without the second upright wall. As could be appreciated, in many embodiments the boundaries between the top wall of the tile and between the first and the second upright walls are hard to define, since there is a variety of possible designs and since in many embodiments there contour of these three walls (or at least of one upright wall and the top wall) is outlined by one continuous line. Therefore, many times in this specification, when defining the relations between the first and the second upright walls, there will be mentioned the gap formed in between these walls, without referring to the top wall which however always connects them from above in one of the plurality of possible designs.

According to various preferred embodiments the spacers are formed in random intervals between one another in order to prevent spacers of one roofing plate from penetrating the cuts from which formed and bent the corresponding spacers of a neighboring roofing plate located underneath.

According to various preferred embodiments of the present invention, mini ribs are located at the boundary region between a top wall of the roofing plate and at least one of the first and the second upright walls acting as struts connecting between mid portions of at least one of the upright walls and corresponding mid portions of the top wall of the roofing plate and resisting increase in the bending angle between the at least one upright wall and the top portion of the roofing plate.

Preferably the roofing plate according to the present invention is further comprising prefabricated apertures located at the third upright wall in predetermined intervals, useful for locating a horizontal joining member connecting between the third upright wall and a second upright wall of an adjacent similar roofing plate.

Preferably the roofing plate according to the present invention is further comprising a fifth principal wall bent horizontally from the lower end of the first upright wall to form a contact and connecting region with the widely spaced apart rafters of the roof construction. Furthermore, integral mini ribs are preferably located at the boundary region between the first upright wall and the fifth principal wall, wherein the mini ribs are acting as struts connecting between mid portions of the upright wall and corresponding mid portions of the fifth wall of the roofing plate and resisting increase in the bending angle between the upright wall and the fifth wall.

When using a sheet metal as a raw material for the roofing plate, the mini ribs are preferably formed as small deformations in the material, at the boundary regions between the walls that should be reinforced.

The present invention further relates to a support member for use with the self supporting tiles, to a roofing method using the tiles and the click-on supporter, and to a roof constructed accordingly.

The support member for roofing plates according to the present invention is comprised of a base portion adapted to contact a rafter from below, an upright leg upwardly protruding from the base portion and dimensioned as to contact and support either the top wall of a the roofing plate or the upright self supporting wall, and a mutual connection with the roofing plate, useful for holding the support member attached to the plate in position during the build process of the roof, without needing to hold and place the support member separately. The mutual connection according to the present invention is preferably a click-on connection, but may be any other appropriate connection which may free the hands of the construction worker from the need to grip the supporter. The comfortable click-on connection of the support member disclosed by the present invention, not only saves labor, but also improves the safety of work in the heights of roofs, by freeing the hands and the mind of construction workers from concentrating in how to keep the support member in place during its fastening.

In order to avoid heat and cold bridging between metal made roofing plate and metal made rafters, the support member is preferably fabricated from a heat isolating substance such as plastic or similar polymeric material. The support member may be produced either by casting of complete units, or by extrusion process forming an elongated profile which is then being cut in similar intervals into a plurality of support members of a similar shape.

The roofing method for pitched roofs having ridge and eaves according to the present invention, inter alia comprising; (a) erecting roof infrastructural construction having widely spaced apart rafters without crossing purlins, wherein the average space between two neighboring rafters is greater than 2 meters; (b) positioning a first roofing plate, or a first line of roofing plates, adjacent the roof eaves, wherein said plates are of a type defined by the text (and/or the figures) of the present invention; (c) clicking-on at least one support member of the type defined by the text (and/or the figures) of the present invention, to the rear portion of each roofing plate in a position corresponding to a rafter crossing underneath; (d) joining the support member with the roofing plate held thereof, to the rafter; (e) positioning a second roofing plate, or a second line of roofing plates, from above the first ones, wherein the third upright surface of each of the second roofing plates is attached to the second upright surface of each of the first roofing plates; (f) joining together the second upright surface of a second roofing plate and the third upright surface of a first roofing plate, wherein the joint is by means horizontally oriented joining members that are spaced laterally in predetermined intervals; (g) repeating steps 'c' to 'f' while referring the second roofing plate of a former repeat as a first roofing plate or plates for the current repeat, until roofing the entire roof.

When using the roofing plates with the fifth wall (in the context of the present invention will be referred to also as "flange" or "horizontal flange") as explained hereinbefore, the same wall may be utilized also for the build of an isolating layer underneath the roof, thus reducing furthermore the labor and time conventionally involved when the isolation is built separately. If so desired, the roofing method may further comprise the positioning of a first end of a block of isolating material to lean on the fifth principal wall located at the rear portion of each roofing plate, and catching a second end of the block to the first upright surface of a second roofing plate, wherein said positioning is in correlation with the positioning of the roofing plates such that the completion of the roofing process is accompanied by a completion of an entire isolating layer. Since isolating material is normally very soft, it could be very facile way to catch it to first upright surface of the relevant roofing plate by means of nails (e.g. of a length of between 2 and 10 cm, each) inserted into the upright first surface in a horizontal orientation through appropriate apertures. Thus, according to the preferred embodiment of the present invention the first upright surface is prefabricated with apertures useful for the insertion of horizontally oriented nails for catching blocks of isolating material.

Due to the fact the vertical load on a roofing plate of the present invention is self supported by the plate, without the use of external purlins, those portions of the plate which are used for the support, can be seen as a purlin substitute. Since the fortunate mechanical features of the roofing plates according to the present invention which allows for a sparse supporting structure of the roof having widely spaced apart rafters, are achieved due to the features of the vertical support implementing the principles of the present invention, this portions of the roofing plate using for the support may be utilized separately, as purlins substitute, for supporting conventional tiles. Therefore, the present invention relates also to a substitute for conventional purlins. This purlin substitute according to the present invention, is an example how one may utilize the principles of the present invention partially or in an incomplete manner, in order to gain an increase in load withstanding capabilities, or in order to reduce roofing costs, in a partial manner. In this regard, the purlin substitute together with the tiles supported by, should be seen and interpreted as one integral unit being a deficient imitation of the roofing plate of the present invention.

The Purlin substitute, comprising (a) a sheet metal beam having a first and a second upright walls forming a gap in between and both are extending along the entire longitudinal dimension of the beam for self supporting of at least one roofing plate, the first wall is being oriented toward the ridge and the second wall is being oriented toward the eaves, when the roofing plate is mounted on a roof, the walls are connected to each other at their upper end either directly (having a cross section view of an inverted V shape or U shape) or through an horizontally oriented wall (either flat, or wavy); (b) at least two support members for supporting the beam, each support member is comprised of a base portion adapted to contact a rafter from below, an upright leg upwardly protruding from the base portion and dimensioned as to contact and support either a top portion of the beam or at least one of its upright walls, and a mutual connection with the beam, useful for holding the support member attached to the beam in position during the build process of the roof, without needing to hold and place the support member separately.

According to one preferred embodiment the beam of the purlin substitute is further comprising a horizontally oriented flange extended from the bottom end of the rear upright wall. Further more, and according to various preferred embodiments of the purlin substitute mini ribs are formed along the folding areas of the beam walls in order to eliminate flattening of the upright walls to the horizontal in load conditions.

According to the best mode of the purlin substitute, the supported roofing plate forms an integral part with the beam, in the following manner: the beam is further comprising (c) an upright third wall, also being oriented toward the eaves, parallel to and adjacent the second upright wall of a neighboring similar beam having integral roofing plate, when the beams are mounted on a roof; and (d) a fourth wall extending along the entire longitudinal dimension of the beam leveled and delimited between the bottom of the upright second wall and the top of the upright third wall and being oriented facing the sky when the beam with its integral roofing plate is mounted on a roof.

The present invention will be further explained in detail by FIGS. 1-19. These figures are solely intend to illustrate several embodiments of the present invention, and some prior art figures for comparison, and in no manner intend to limit the scope of this invention.

BRIEF DESCRIPTION OF THE FIGURES

FIG. 1 illustrates in isometric view a so called Z-beam tile according to the D1 prior art invention.

FIG. 2 illustrates a cross section view of the prior art Z-beam tile taken along a valley region of the wavy shaped horizontal wall of the tile.

FIG. 3 illustrates a cross section view of the prior art Z-beam tile taken at a top region of the wavy shaped horizontal wall of the tile.

FIG. 3A illustrates a side view of a portion of a roof covered by a Plannja product corresponding to the D1 prior art invention and making use of a support strip according to the D2 prior art invention.

DETAILED DESCRIPTION OF THE FIGURES

Figure 4:
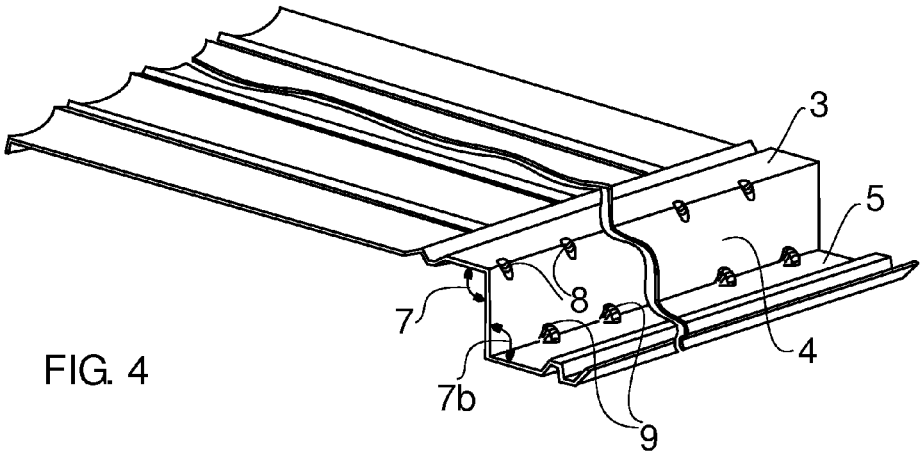
FIG. 4 illustrates an isometric view of one embodiment of a roofing plate according to the present invention.

FIG. 1 illustrates in isometric view a so called Z-beam tile (1) according to the D1 prior art invention. The tile has a horizontal wall (2), a top wall (3) of the Z-beam, an upright wall (4) of the Z-beam, and a flange (5) that is a horizontal wall of the Z-beam. As can be observed, the horizontal wall (2) is wavy, thus having apexes (2*a*) and valleys (2*b*), wherein the apexes are leveled the same with the top wall (3) as can be seen at the meeting points (2*a*3). As can be further observed, the upright wall (4) is reinforced by means of folds (4*a*) in order to improve its capability of withstanding vertical pressures in the direction of the arrow (4*b*). Additional reinforcing folds (3*a*) (5*a*) extend respectively along the longitudinal direction of the top wall (3) and along the longitudinal direction of the flange (5). It could be clearly appreciated that whether a pressure is exerted in the direction of the arrow (6), non of the above mentioned reinforcements are effective to prevent an enlargement in the predetermined angle (7) existing between the upright wall (4) and the top wall (3), which in turn flattens the upright orientation of the upright wall (4), while there is no prevention for a similar enlargement that occurs in the angle (7*b*) between the upright wall (4) and the flange (5). It is clear that as much as the upright wall (3) changes its orientation toward the horizontal, it loses its resistance against vertical loads, while simultaneously losing the significance of its reinforcing folds (4*a*). The folds (3*a*) functions very badly in the above mentioned flattening process and increase the deterioration in the tenability of the tile against vertical loads, since they act as pivoting axis helping the deflection of the upright wall (4) by compensating the enlargement in the angle (7) by arching the top wall (3) width.

It will therefore be an object of the present invention to provide the guidelines for increasing the resistance of the upright self supporting wall against regression in its upright orientation, implementation of which will allow for a production of a new type of self supporting roofing plate having dramatically improved attributes.

FIG. 2 illustrates a cross section view of the prior art Z-beam tile of FIG. 1, taken along a valley region (2*b*) of the wavy shaped horizontal wall of the tile. The valley region is elevating toward the top wall (3) in an incline contoured wall (2*b*3). Although this inclined line which is resembled in some of the Figures of the D1 as having upright orientation, however it is not a continuous wall along the entire longitudinal direction of the Z-beam, and it decrease its height until it stops every time the wavy shaped horizontal wall elevate to reach an apex region (2*a*) (not shown in this Figure).

FIG. 3 illustrates a cross section view of the prior art Z-beam tile of FIG. 1, taken along an apex region (2*a*) of the wavy shaped horizontal wall of the tile. In such regions of the tile the incline contoured wall (2*b*3) (see FIG. 2) is absent, while the horizontal surface is leveled the same as the top wall (3) of the Z-beam. As can be appreciated the wall (2*b*3) of FIG. 2, which has a small height in average, and which at predetermined intervals completely does not exist, functions badly or actually has a neglectable functionality in bearing vertical loads exerted on the Z-beam. Accordingly, it does not help to reduce the tendency of the predetermined angle (7) to increase under the pressure of a load on the Z-beam. Furthermore, it lacks unequivocal capabilities in blocking wind driven rain water from reaching from the horizontal wall (2) to the flange (5) over the top wall (3).

FIG. 3A illustrates a side view of a portion of a roof, covered by a Plannja product (10) corresponding to the D1 prior art invention and making use of a support strip (11) according to the D2 prior art invention. The strip (11) and the tile (10) are connected together by means of a joining member (12), and the spikes that are located in the strip in predetermined intervals help for correct positioning of the tiles according to the predetermined intervals. Without using the strip, it would be difficult to position the tiles in predetermined intervals, since the tiles are connected to one another by means of a vertically oriented screw (13) passing through a horizontally oriented tongue extending from the end of the tile (10) to the left side of the illustration, which can be positioned and joint without restriction at any point along the horizontal wall of the tile (10*b*). This type of tile does not allow for a connection between the tiles through horizontally oriented screws, since there is no second upright wall at the front side of the Z-beam support to which a horizontal screw can be fastened.

FIG. 4 illustrates an isometric view of one embodiment of a roofing plate according to the present invention. This preferred embodiment differs from the D1 invention, in that it has a plurality of mini ribs (8) located in predetermined intervals along the angle (7) of the fold existing between the upright wall (4) and the top wall (3) of the Z-beam. These mini ribs act as struts connecting between corresponding mid portions of the walls (3) and (4) thus maintaining the angle (7) in its initial state and dramatically increasing its resistance to flattening under load conditions. This preferred embodiment furthermore differs from the D1 invention, in that it has one additional series of mini ribs (9) located in predetermined intervals along the angle (7*b*) of the fold existing between the upright wall (4) and the flange (5) of the Z-beam. These mini ribs act as struts connecting between corresponding mid portions of the wall (4) and the flange (5) thus maintaining the angle (7*b*) and dramatically increasing its resistance to flattening under load conditions. When the roofing plate is made from sheet metal, the mini-ribs are formed in the sheet during the formation process of the plate (i.e. each of the mini ribs is actually a double wall deformation or fold knocked in the sheet metal material e.g. by means of die pressing).

Figure 5:
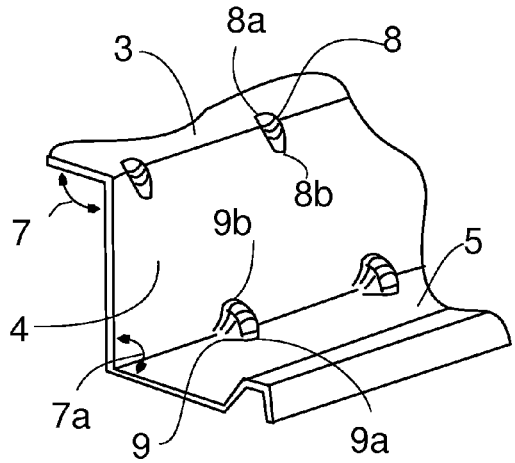
FIG. 5 illustrates a closer view at mini-rib areas of the embodiment illustrated in FIG. 4.

FIG. 5 illustrates a closer view at a mini-rib areas of the embodiment illustrated in FIG. 4. Mini-rib (8) connects a mid portion (8*a*) of the top wall (3) with a mid portion (8*b*) of the upright wall (4), thus acts as a strut to prevent change in the predetermined angle (7) between the walls and dramatically increases the resistance of the upright wall (4) to flattening under load conditions. Mini-rib (9) connects a mid portion (9*a*) of the flange (5) with a mid portion (9*b*) of the upright wall (4), thus act as a strut to prevent change in the predetermined angle (7*b*) between the walls.

Figure 6:
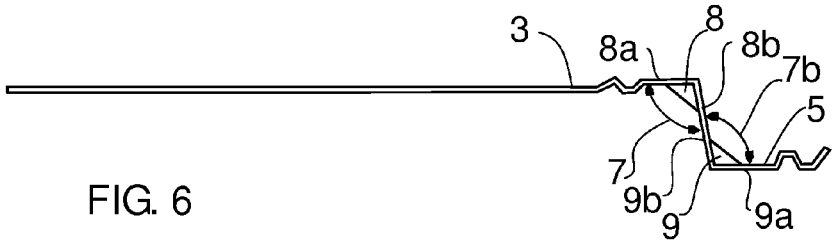
FIG. 6 Illustrates a cross sectional view of the mini-rib area illustrated in FIG. 5.

FIG. 6 Illustrates a cross sectional view of the mini-rib area illustrated in FIG. 5. Mini-rib (8) connects a mid portion (8*a*) of the top wall (3) with a mid portion (8*b*) of the upright wall (4), thus acts as a strut to prevent change in the predetermined angle (7) between the walls and dramatically increases the resistance of the upright wall (4) to flattening under load conditions. Mini-rib (9) connects a mid portion (9*a*) of the flange (5) with a mid portion (9*b*) of the upright wall (4), thus act as a strut to prevent change in the predetermined angle (7*b*) between the walls.

Figure 7:
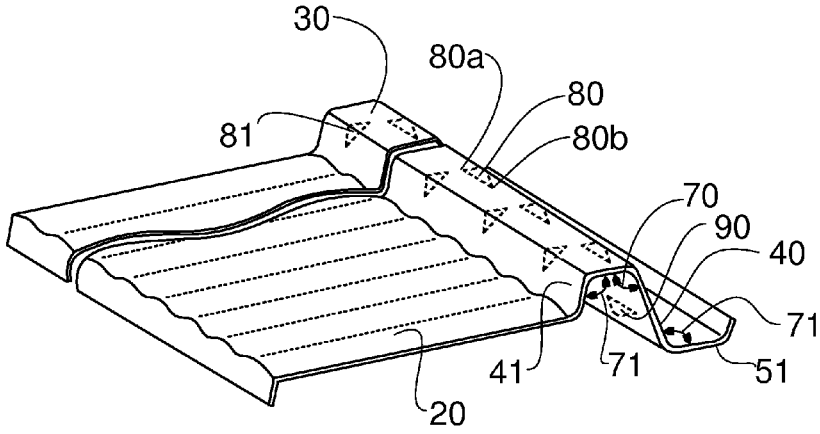
FIG. 7 Illustrates an isometric view of another embodiment of a roofing plate according to the present invention.

FIG. 7 Illustrates an isometric view of another embodiment of a roofing plate according to the present invention. In this embodiment (that is the preferred one according to the present invention), the self supporting upright wall (40) is accompanied all along its longitudinal dimension with a secondary upright wall (41), which reduces the load exerted upon the upright wall (40), thus increases its resistance to flattening under load conditions. The secondary upright wall (41) is of a height of at least 12 millimeters above the apexes of the horizontal wall (20), in order to completely prevent wind driven rain water from passing inside the house, as may occur with tiles having the horizontal wall at a similar level with the top wall, with tiles having a moderate incline (not upright) between the horizontal wall and the top wall, or even with files having upright wall which is segmented (i.e. is missing at the apexes of the horizontal wall). According to the preferred embodiment the upright wall (40) has also mini-ribs (80) connecting it with mid portions (80*a*) of the top wall (30) in order to maintain the angle (70) between both walls under load conditions. Similar mini-ribs (81) (90) are respectively connecting the upright wall (41) with the top wall (30), and the flange (51) with the upright wall (40), in order to maintain the angles (71) (71*a*) between the walls under load conditions.

Figure 7A:
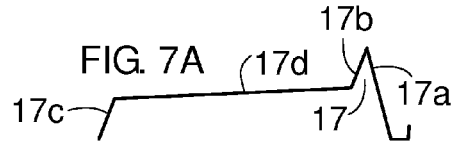
FIGS. 7A-7C illustrates an example of cross sectional views of three roofing tile contours which fall within the scope of the present invention.
Figure 7B:
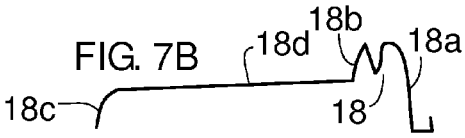
Figure 7C:
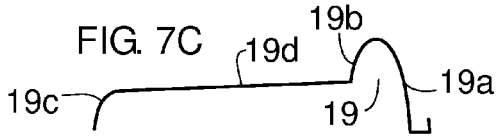

FIGS. 7A-7C illustrates cross sectional views of three roofing tile contours (having vertical double wall supports in the shape of inverted V, the letter M, and inverted U, respectively, all of which falls within the scope of the present invention since they have (respectively) the following four principal walls: (a) a first (17*a*)(18*a*)(19*a*) and a second (17*b*)(18*b*)(19*b*) upright walls, forming a gap (17)(18)(19) in between and both are extending along the entire longitudinal dimension of the plate for self supporting of the plate, the first wall is being oriented toward the ridge and the second wall is being oriented toward the eaves, when the roofing plate is mounted on a roof;

(b) an upright third wall (17*c*)(18*c*)(19*c*), also being oriented toward the eaves, parallel to and adjacent the second upright wall of a neighboring similar roofing plate when the roofing plates are mounted on a roof; and (c) a fourth wall (17*d*)(18*d*)(19*d*) extending along the entire longitudinal dimension of the plate leveled and delimited between the bottom of the upright second wall and the top of the upright third wall and being oriented facing the sky when the roofing plate is mounted on a roof.

Figure 8:
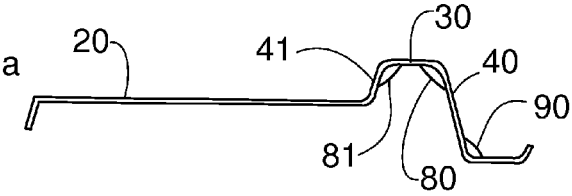
FIG. 8 illustrates a cross sectional view of the embodiment illustrated in FIG. 7.

FIG. 8 illustrates a cross sectional view of the embodiment illustrated in FIG. 7.

Figure 9:
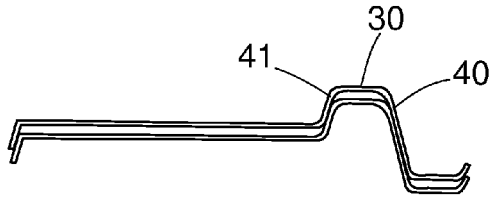
FIG. 9 illustrates cross sectional view over two similar covering plates of the type illustrated in FIG. 8, stacked together one inside another.

FIG. 9 illustrates cross sectional view over two similar covering plates of the type illustrated in FIG. 8, stacked together one inside another. It can be appreciated that the addition of the secondary upright wall (41) forms with the upright wall (40) a trapezoid shaped gap in between, which should accommodate (during storage and delivery of the roofing plates) the outer dimensions of a similar trapezoid shape of a similar self supporting roofing plate located underneath. As the motivation is to have the upright walls (40)(41) being in a maximal upright orientation, i.e. with angles as much as possible closer to 90 degrees with respect to the top wall (30) (in order to gain max load support capability), a problem occurs of undesired lock of one trapezoid shape inside another, when the trapezoid shape is close to the shape of a rectangle. This problem does not exist with tiles having only one upright wall, such as the tile of the D1 invention. Therefore, a progression from tiles having single self supporting upright wall to roofing plates having double self supporting upright walls according to the preferred embodiment of the present invention may not survive in a competitive market, wherein the benefits from having dramatically improved load capacities will be negatively compensated by ineffective packaging and storage manner resulting from the problem of locking of tiles one inside another. One solution to that problem may be the use of strips of cheap material for spacing between adjacently stacked roofing plates, however, this solution involves undesired logistic management which cost in material and in man labor. The preferred solution given by the present invention to this problem will be disclosed in the following FIG. 10.

Figure 10:
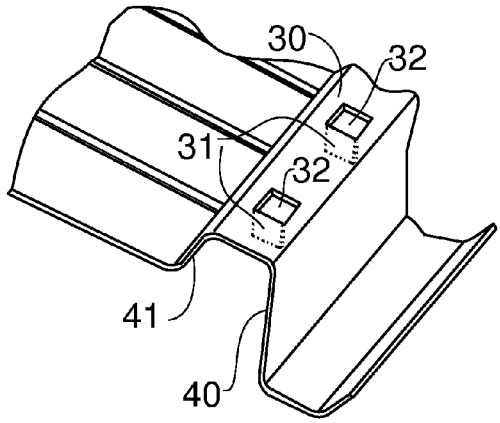
FIG. 10 illustrates an isometric view of a double wall support embodiment having integral spacers according to the present invention.

FIG. 10 illustrates an isometric view of a double-wall self-supporting embodiment having integral spacers according to the preferred embodiment of the present invention. According to the preferred embodiment the spacers (31) are produced simultaneously with the production of the roofing plate by means of cutting and bending portions (32) of the top wall (30) having dimensions appropriate for blocking the top wall of a corresponding roofing plate placed below, from reaching too much narrow region of the trapezoid shape between the upright walls (40)(41). This prevents lock of one plate inside another. The spacers (31) are preferably located along the top wall (30) in randomly changed intervals, in order to prevent penetration of spacers of one roofing plate into cut portions (32) of a neighboring roofing plate placed below.

Figure 11:
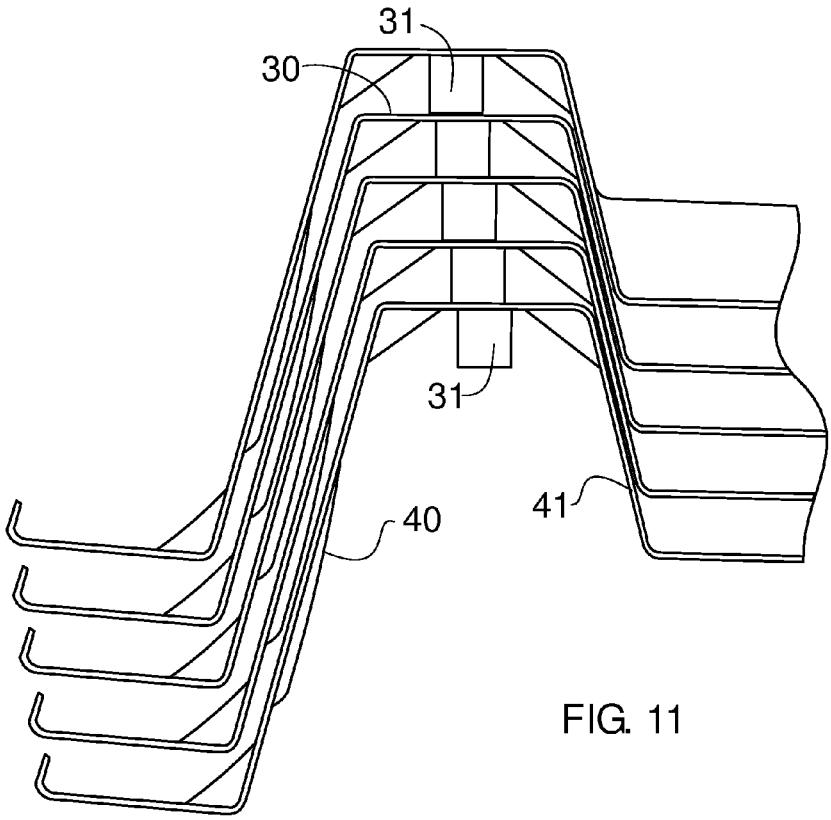
FIG. 11 illustrates cross sectional view over five similar covering plates of the type illustrated in FIG. 10, stacked together one inside another.

FIG. 11 illustrates cross sectional view over three similar covering plates of the type illustrated in FIG. 10, stacked together one inside another, with the spacers (31) of one roofing plate preventing the top (30) of another roofing plate from coming close to the narrower region of the trapezoid shape gap existing between the upright walls (40)(41).

Figure 12:
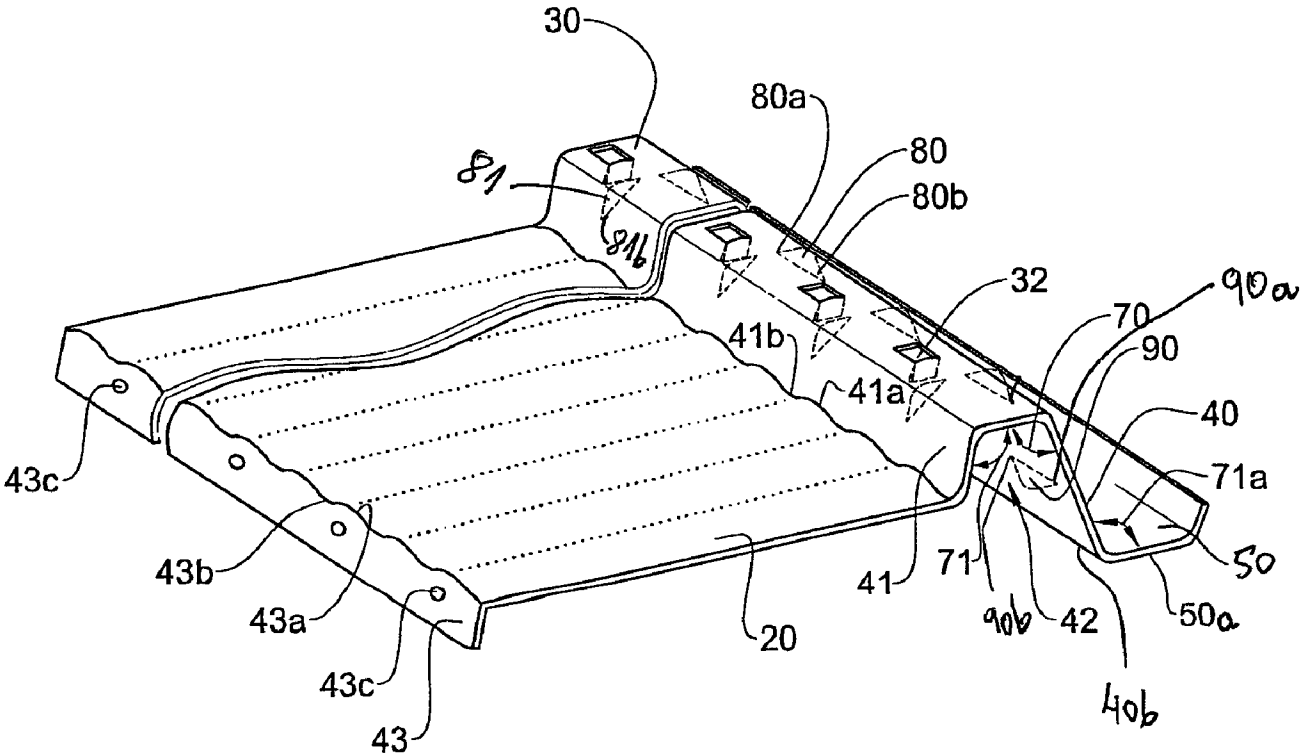
FIG. 12 illustrates an isometric view of a preferred embodiment of the roofing plate according to the present invention.

FIG. 12 illustrates an isometric view of a preferred embodiment of the roofing plate according to the present invention. It is comprised of; (a) a first and a second upright walls (40) (41), respectively, forming a gap (42) in between and both are extending along the entire longitudinal dimension of the plate for self supporting (i.e. without purlins) of the plate, the first wall (40) is being oriented toward the ridge and the second wall (41) is being oriented toward the eaves, when the roofing plate is mounted on a roof; (b) an upright third wall (43), also being oriented toward the eaves, parallel to and adjacent the second upright wall (41) of a neighboring similar roofing plate when the roofing plates are mounted on a roof (see FIGS. 17, 18); (c) a fourth wall (20) extending along the entire longitudinal dimension of the plate leveled and delimited between the bottom (41*a*)(41*b*) of the upright second wall and the top (43*a*)(43*b*) of the upright third wall (43), and being oriented facing the sky when the roofing plate is mounted on a roof; (d) a fifth wall (50) bent horizontally from the lower end (40*b*) of the first upright wall (40) to form a contact and connecting region (50*a*) with the widely spaced apart rafters of the roof construction; (e) a top wall (30) connecting between the first and the second upright walls (40) and (41); (f) a plurality of integral mini ribs (80) (81) (90) located at the boundary regions between the top wall (30) and between the first and the second upright walls (40)(41), and between the first upright wall (40) and the fifth wall (50), wherein the mini ribs act as struts connecting between mid portions (80*b*)(81*b*)(90*b*) of the upright walls and corresponding mid portions (80*a*)(81*a*) of the top wall and (90*a*) of the fifth wall (50) of the roofing plate, thus resisting increase in the bending angles (70)(71)(71*a*) existing between the upright walls and the top wall and between the fifth wall and the first upright wall, respectively.

Figure 13:
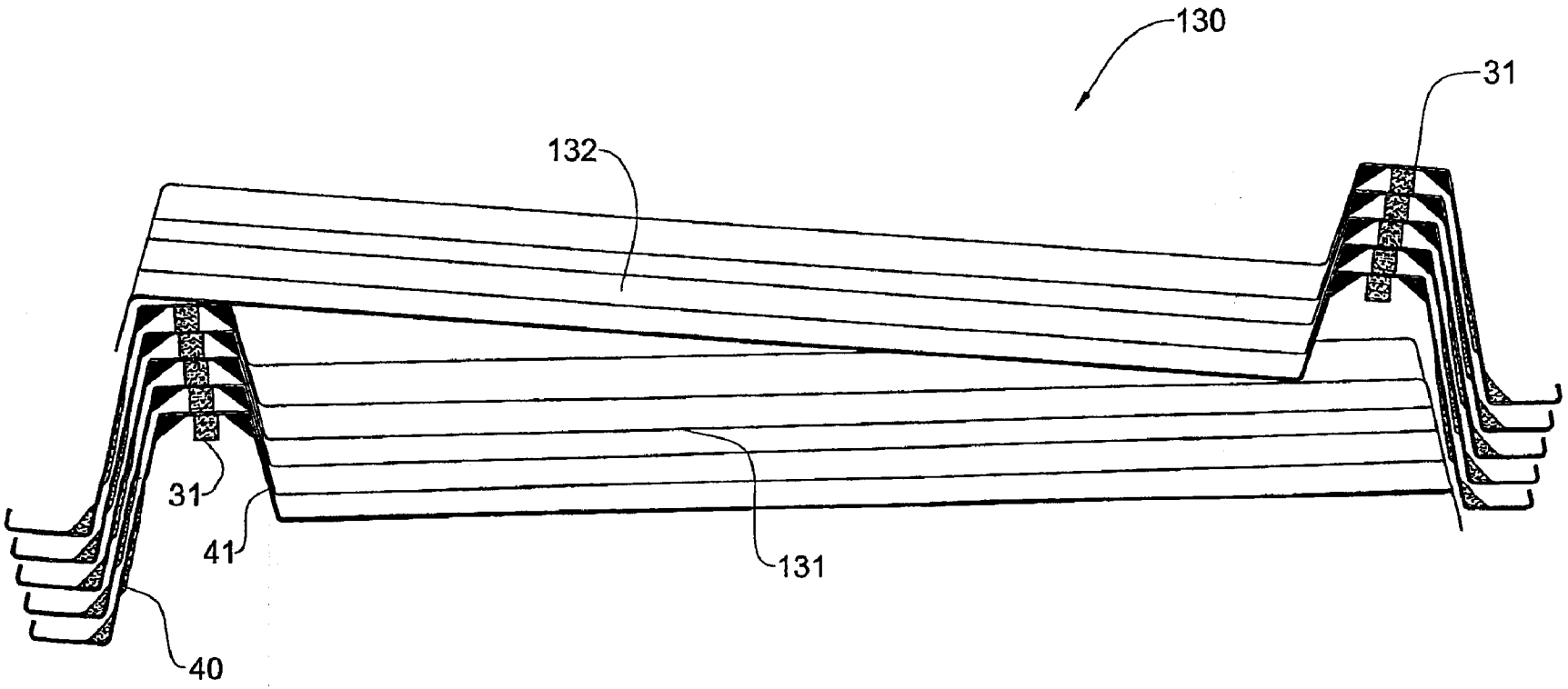
FIG. 13 illustrates a cross sectional view over an economic packaging of ten stacked roofing plates according to the preferred embodiment of the present invention.

FIG. 13 illustrates a cross sectional view over an economic packaging (130) of ten stacked roofing plates according to the preferred embodiment of the present invention. The roofing plates are arranged in two groups (131)(132) of five plates each. Each of the two groups consists of a stack of five plates stacked one inside another with the integral spacers (31) preventing locking of the self supporting upright walls (40) (41) of one plate among the similar self supporting walls of the plate above. The two groups are arranged with the self supporting upright walls of each group at opposite direction of the plate width. This is an example how the roofing plates of the present invention could be stacked and arranged in a convenient and economic manner. The amount of plates in a stack and their grouping in opposite directions in a stack, is not limited to the specific numbers presented in this example, and may vary according to the specific design, dimensions, material thickness and other factors and requirements, without departing from the scope of the present invention.

Figure 14:
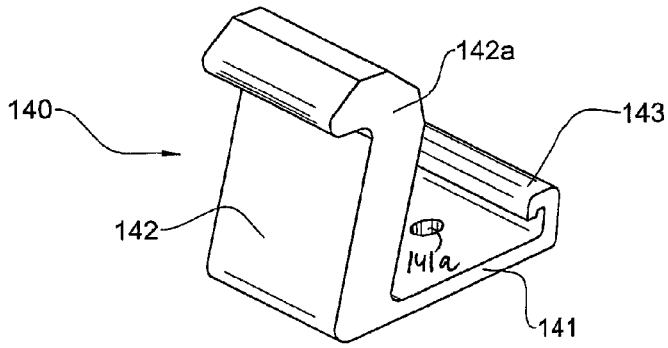
FIG. 14 illustrates an isometric view of a support member according to the present invention.

FIG. 14 illustrates an isometric view of a support member (140) according to the present invention. The support member has a base (141) adapted to seat on a rafter and having a crossing hole (141*a*) for a screw, a support (142) having upper end (142*a*) matching the inner shape of the gap between the self supporting upright walls of a roofing plate, and a tail (143) matching the rear end of a roofing plate, such that when the support member (140) is brought to appropriate position on a roofing plate it could be clicked on to being held to the plate.

Figure 15:
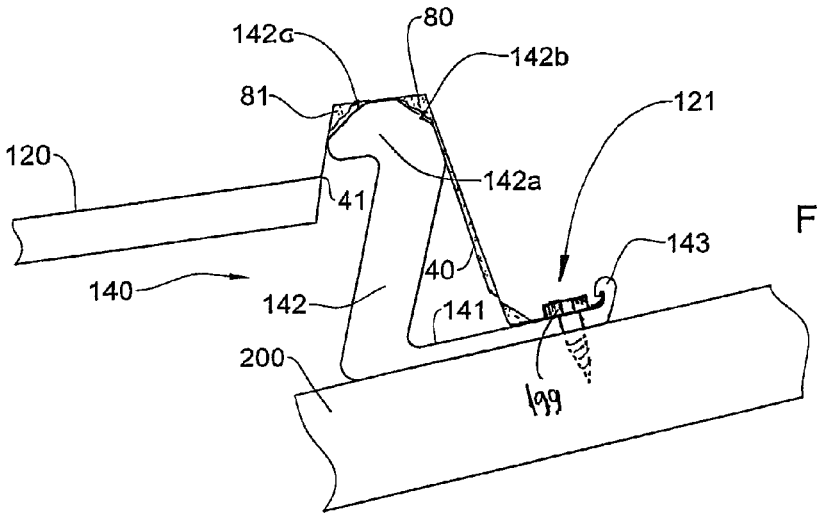
FIG. 15 illustrates a side view of a roofing plate with the support member attached unto according to the preferred embodiment.

FIG. 15 illustrates a side view of a roofing plate (120) with the support member (140) attached unto according to the preferred embodiment. The base (141) of the support member is oriented to seat on a rafter (200), the rear end (121) of the plate is captured inside the tail (143) of the support member, and the upper end (142*a*) of the support is matching the inner shape of the gap between the self supporting upright walls (40)(41) of the roofing plate, thus the support member is clicked to and held by the plate, and both together they are fastened to the rafter (200) by means of a screw (199). The upper end (142*a*) of the support (142) is shaped with inclined contours (142*b*)(142*c*) matching the corresponding opposite contour of the mini ribs (80)(81), such that the positioning of the support is not disturbed by the existence of the mini ribs. In case there is located an integral spacer (detail no. 31 of FIG. 10) protruding inside the gap and disturbing correct positioning of the supporter, the spacer can easily be bent back to flatten using a finger (no tool is required).

Figure 16:
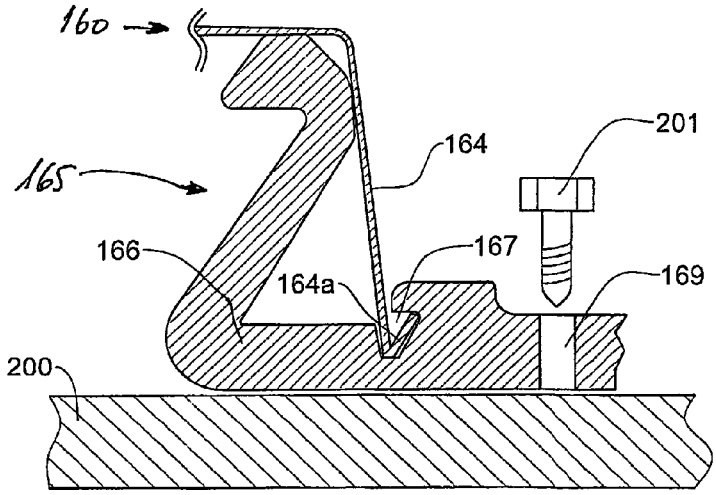
FIG. 16 illustrates a side view of another embodiment of roofing plate according to the present invention with another embodiment of a support member according to the present invention.

FIG. 16 illustrates a side view of another embodiment of roofing plate according to the present invention with another embodiment of a support member according to the present invention. According to this embodiment the roofing plate (160) has a first self supporting upright wall (164) bent at its lower end to having a protrusion (164*a*). This protrusion is matching an appropriate groove (167) made in a support member (165). Lower end of the upright wall (164) is passing through the groove (167), such that the support member (165) could be slid and brought to appropriate position above a rafter (200) to be fitted to, wherein the lower end of the upright wall is caught inside the groove, thus the plate is being held by the supporter that is fastened to the rafter (200) by means of a bolt (201) passing through appropriate hole (169) made in the base (166) of the support member. According to this embodiment the roofing plate needs no flange at its rear, thus avoiding the material cost of the flange which is nearly 5% saving in the material cost of the roofing plate.

Figure 17:
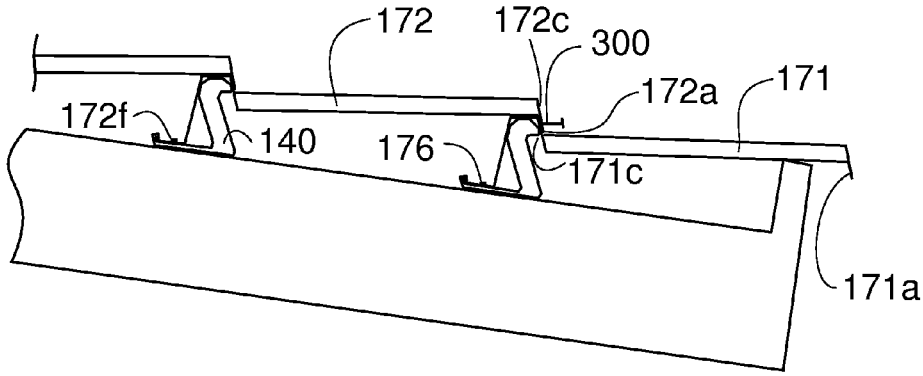
FIG. 17 illustrates two roofing plates according to the present invention in a typical position during a build process of a roof.

FIG. 17 illustrates two roofing plates (171)(172) according to the present invention in a typical position during a build process of a roof. The third upright wall (172*c*) of the plate (172) is brought to contact the second upright wall (171*c*) of the plate (171) in order to ensure appropriate positioning of the plate (172), then both walls may be joined by screw (300) that is oriented horizontally, i.e. parallel to the horizontal wall of the plate (171). The screw is located at a top portion of the walls it joins, through pre-fabricated aperture in the third upright wall (172*c*). The pre fabrication of the apertures for joining the plates to one another ensures appropriate installation by the constructor, wherein the positioning of the joining members at a top portion of the upright walls is useful for preventing rain water leakage through screw apertures. By adapting the roofing plate to the above described horizontal orientation of the joining member, there is no need in a horizontal extension (tongue) bent at the lower end of the third upright wall (as exists in the D1, and through which a vertical joining member is passing for connecting between the tiles), thus the material cost of the redundant horizontal extension could be saved, or the saved material could be utilized to further extending the height of the second upright wall (171*c*), thus improving furthermore the blocking of wind driven rain, while increasing furthermore the tenability of the roofing plate against vertical loads. After the third upright wall (172*c*) of the plate (172) is joined by horizontally oriented screws to the second upright wall (171*c*) of the plate (171), the fifth wall (172*f*) of the plate (172) could be fastened to the rafters crossing its width from below. This is preferably done through the use of support members (140) clicked onto the rear portion of the plate at the appropriate locations, namely above each corresponding rafter crossing the plate from below. After the positioning and clicking the support unto the rear portion of a plate, it could be easily anchored to the rafter crossing underneath by means of a vertical bolt in the same manner the former plate was anchored by the vertical bolt (176). After anchoring of the plate (172) to the crossing rafters of below, another plate could be placed with its third upright wall adjacent the second upright wall of the plate (172), then be connected by horizontal screws located according to the prefabricated apertures made in the third wall in advance, and so on. The roofing plate (171) that is illustrated in a cross sectional view from the side, represents a raw of similar plates which, together, form a first level of the roof. This raw of plates is to be assembled before starting the positioning of the plate (172), that also represents a raw of similar plates which, together, form a second level of the roof. A raw of a third level of the roof, and so on, are being positioned and assembled after the assembling of the former level raw of plates, until the roof is covered. The positioning and assembling of plates in a raw (i.e. in one roof level) is made such that there is preferably one wave overlapping between two neighboring plates in a raw. One plate is placed and assembled by joining it to a first rafter with a vertical bolt (176) on a first end of the plate, preferably together with a support member (140). Thereafter, the plate is being fastened to another rafter in a similar manner, preferably together with a second support member (140). Normally (and due to the significantly increased self supporting capacities of the roofing plates according to the present invention, there will probably be no more than two or three rafters underneath one plate, i.e. two rafters under the two ends of the plate, and one additional rafter in the middle of the plate. When the second end of a plate is to be joint to the rafter, another plate is placed in order to continue the line, with one wave overlapping with the former plate, and the two plates are joint together to the rafter underneath, using one common bolt for both, and preferably, one common support member (140) as well. After the assembling of a first level raw of plates, a second level is assembled in a similar manner, wherein each plate is first being located with its third upright wall adjacent the second upright wall of the plate below, then connected by horizontal screws as explained above, until the end wave of the plate is being overlapped by the first wave of another plate in the raw, and the two overlapping third upright walls of the two plates are being fastened together to the second upright walls of two overlapping plates of the former raw. In this manner the raw of plates are being assembled one after another, until covering the entire roof.

Figure 18:
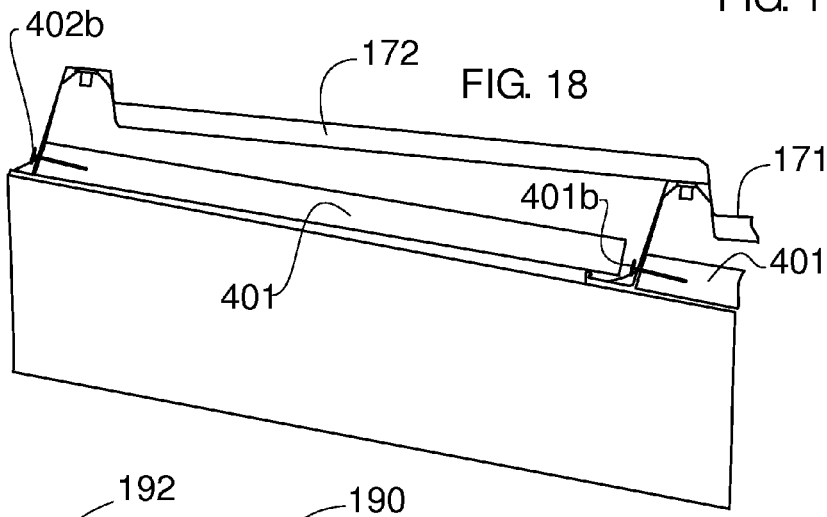
FIG. 18 illustrates a cross sectional view of a roof section covered with plates and with isolating blocks according to the present invention.

FIG. 18 illustrates a cross sectional view of a roof section covered with plates (171) (172) and with isolating blocks (401) (402), wherein the isolating blocks are being placed and caught between the roofing plates during the process of covering the roof with the plates, thus saving additional work costs for isolating the roof separately at completion of its construction. The isolating blocks (401)(402) could be assembled each immediately after fastening its corresponding roofing plate (171) and (172) respectively to the rafters below, by placing one end of the isolating block on a flange of a roofing plate of a preceding level of the roof, and by inserting to it horizontal nails (401*b*) and (402*b*), respectively. The insertion of the nails could easily performed manually, when the isolating material is soft which is a common situation, and through prefabricated apertures prepared in advance for this purpose in the lower ends of the first upright walls.

Figure 19:
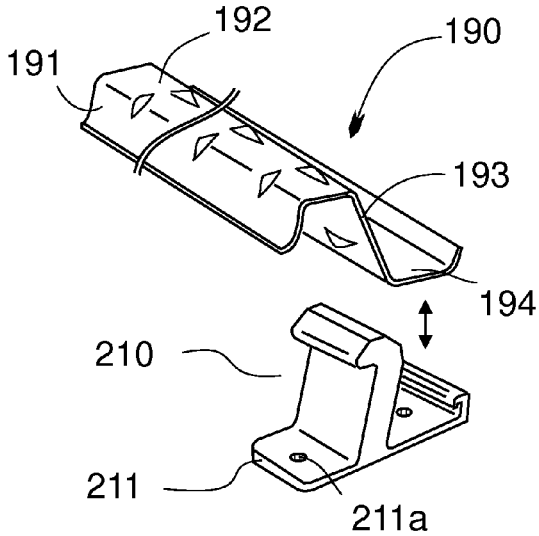
FIG. 19 illustrates an isometric view of purlin substitute according to the present invention.

FIG. 19 illustrates in an isometric view a purlin substitute (190) according the present invention. It comprises a sheet metal beam (190*a*) and at least two supporter elements (210) (only one is seen in this figure). The sheet metal beam comprises two upright supporting walls (191)(193) forming a trapezoid shaped gap in between, a top wall (192) and a horizontal flange (194). The sheet metal beam is further comprising mini ribs for preventing flattening of the upright orientation of the upright walls, and it may further include spacers for preventing stacking when being nested one inside another for a storage or delivery. According to the best mode, the purlin substitute further comprises integral roofing plate, i.e. it may become the roofing plate of the present invention, e.g. as defined by FIG. 12. The supporter members could be of the type illustrated in FIG. 14, or preferably of the type illustrated in the present figure, which differs from that of FIG. 14 by having additional protrusion (211) from its front side, with a crossing hole (211*a*) allowing to connect it to a rafter by means of one additional screw, which seems to be more appropriate in case like this, where a purlin substitute is to be connected, i.e. without a stabilizing connection to the rafter provided in advance as it is in case of a construction that is based on complete roofing plates (i.e. wherein the support member is clicked on a roofing plate which is already connected to the rafter from its front side).

The invetion claimed is:

1. Self supporting roofing plate, a plurality of which are to be fit together for covering a pitched roof having a ridge and eaves, in a manner allowing for a sparse supporting structure of the roof having widely spaced apart rafters without crossing purlins, wherein the roofing plate is made of a sheet of material formed to comprise at least the following four non-interrupted walls:

(a) first and second upright walls forming a gap in between and both extending along an entire longitudinal dimension of the plate for self supporting of the plate, wherein, when the roofing plate is mounted on the roof, the first wall is adapted to be closer to the ridge than the second wall, a bottom end of the first wall is configured to contact at least one of the rafters, and a bottom end of the second wall is spaced upwardly from the rafters;

(b) a third upright wall, adapted to be oriented parallel to and adjacent the second upright wall of a neighboring similar roofing plate when the roofing plates are mounted on the roof; and c) a fourth wall extending along the entire longitudinal dimension of the plate, leveled with and delimited between the bottom end of the upright second wall and a top end of the upright third wall, and adapted to be facing the sky when the roofing plate is mounted on the roof, wherein the fourth wall has a wavy shape extending all the way from the bottom end of the upright second wall to the top end of the third wall, and wherein a portion of the second wall above its bottom end and a portion of the third wall below its top end are extending continuously along the entire longitudinal dimension of the plate and are free of said wavy shape.

2. Self supporting roofing plate according to claim 1, wherein the second upright wall has a minimum height, measured between apexes of the wavy shape and a top end of the second wall, greater than 1 cm.

3. Self supporting roofing plate according to claim 1, wherein the second upright wall forms, with the fourth wall, an angle substantially greater than 90 degrees and not greater than 105 degrees.

4. Self supporting roofing plate according to claim 1, further comprising integral spacers located inside the gap between the first and the second walls.

5. Self supporting roofing plate according to claim 1, further comprising integral spacers located inside the gap between the first and the second walls, in random intervals.

6. Self supporting roofing plate according to claim 1, further comprising integral mini ribs located at a boundary region between a top wall of the roofing plate and at least one of the first and the second upright walls, acting as struts connecting between mid portions of at least one of the first and second upright walls and the top wall of the roofing plate, and for resisting an increase in the bending angle between the at least one upright wall and the top wall of the roofing plate.

7. Self supporting roofing plate according to claim 1, further comprising prefabricated apertures located at the third upright wall in predetermined intervals, for locating a horizontal joining member connecting between the third upright wall and a second upright wall of an adjacent similar roofing plate when the roofing plates are mounted on the roof.

8. Self supporting roofing plate according to claim 1, further comprising a fifth wall bent horizontally from the lower end of the first upright wall to form a contact and connecting region with the widely spaced apart rafters of the roof construction.

9. Self supporting roofing plate according to claim 1, further comprising a fifth principal wall bent horizontally from the bottom end of the first upright wall to form a contact and connecting region with the widely spaced apart rafters of the roof, and integral mini ribs located at a boundary region between the first upright wall and the fifth wall, acting as struts connecting between mid portions of the first upright wall and corresponding mid portions of the fifth wall for resisting an increase in the bending angle between the first upright wall and the fifth wall.

10. A self supporting roofing plate according to claim 1, being a unitary unit made from sheet metal, from plastic material, or from a composite material.

* * * * *